US006045392A

United States Patent [19]

Daoud

[11] Patent Number: 6,045,392

[45] Date of Patent: Apr. 4, 2000

[54] MODIFIED INDEX STRIP WITH INTEGRATED PUSH CAP FOR WIRE TERMINATION

[75] Inventor: Bassel Hage Daoud, Parsippany, N.J.

[73] Assignee: Lucent Technologies Inc., Murray Hill, N.J.

[21] Appl. No.: 09/109,271

[22] Filed: Jun. 30, 1998

[51] Int. Cl.[7] ..... H01R 4/24

[52] U.S. Cl. ..... 439/409; 439/403

[58] Field of Search ..... 439/409, 403, 439/399, 942; 29/566

[56] References Cited

U.S. PATENT DOCUMENTS 4,262,985 4/1981 Muehlhausen, II ..... 439/403

5,662,493 9/1997 Reichle ..... 439/409

*Primary Examiner*—Gary F. Paumen

*Assistant Examiner*—Alexander Gilman

[57] ABSTRACT

A modified index strip having an extension with integrated push caps for wire termination. The integrated push caps simplify the operation of and allows connection or rearrangement of a single pair of conductors. The modified index strip having alternating height teeth and a pedestal extension with integrated push caps. The push caps fit over alternating height teeth of a prior art connector module mounted on the modified index strip. Each integrated push cap having a pair of ribs for snubbing and seating a pair of conductors into the insulation displacement connectors of the connector module. One or more pair of chambers are provided at the pedestal extension for isolating and gripping the ends of the conductors. Each push cap is maintained in a closed position by a latching mechanism and a recess-protuberance locking mechanism.

12 Claims, 9 Drawing Sheets

MODIFIED INDEX STRIP WITH INTEGRATED PUSH CAP FOR WIRE TERMINATION

FIELD OF THE INVENTION

The invention relates to an improved device for making electrical connections between a plurality of conductors, which reliably grips and isolates the ends of the conductors, allows the connection of a single pair of conductors and simplifies the operation of accomplishing electrical connections without the aid of extraneous tools; and, particularly, relates to connections between telephone lines at a network interface unit.

BACKGROUND OF THE INVENTION

At present, a wide variety of conductor splicing electrical connectors are used in telephone systems. Generally, these connectors comprise at least two separate and distinct elements, is namely, an index strip and a connector module. U.S. Pat. No. 3,798,587 to B. C. Ellis, Jr. et al. ("'587 patent") discloses one such typical wire connecting blocks, wherein the index strip has a plurality of teeth of alternating height which are spaced-apart, and the connector module has a plurality of slotted insulation displacement connectors and a plurality of teeth of alternating height and spaced-apart, identical to those of the index strip. The '587 patent discloses electrical connections between two sets of conductors are accomplished by first placing the first set of conductors along slots between the spaced-apart teeth of the index strip and the second set of conductors between slots of the insulation displacement connectors of the spaced-apart teeth of the connector module. Then the connector module is placed over the index strip, with the slotted insulation displacement connectors making electrical connection between the first and second set of conductors by penetrating the insulation.

U.S. Pat. No. 4,118,095 to R. N. Berglund et al. ("'095 patent") discloses an improved two-element wire connecting block. Significantly, the '095 patent modifies the connector module disclosed in the '587 patent to facilitate alignment of the slotted insulation displacement connectors and to provide an integral skirt for maintaining electrical isolation of the end of the first set of conductors to minimize short circuits between conductors.

Further improvement of the two-element system is the addition of a third element, a cap module, as disclosed in U.S. Pat. No. 3,772,635 to D. R. Frey et al. ("'635 patent") and U.S. Pat. No. 4,262,985 to A. A. Muehlhausen II ("'985 patent"). The '635 patent discloses a cap module, for use with a modified index strip and a modified connector block, which serves the purpose of snubbing the second set of conductor ends. The '985 patent discloses a cap module capable of gripping, snubbing and isolating the second set of conductor ends. The cap module of both the '635 and the '985 patents are snap-mounted onto the connector module with a latch-hole interlocking mechanism.

Normally the assembly of the wire connecting blocks disclosed in these patents require an expensive tool such as that disclosed in the '635 patent and U.S. Pat. No. 3,898,724 to T. A. Conorich ("'724 patent"). The seating tool is used to trim and properly snub the conductors into slots between the spaced-apart teeth of the wire connecting blocks to achieve electrical connections.

U.S. Pat. Nos. 3,772,635, 3,798,587, 3,898,724, 4,118,095 and 4,262,985 discussed above are hereby incorporated by reference as background of the invention.

Prior art wire connecting blocks described above are suitable for installation and for rearrangement of a large-scale telephone system because typical index strips, connector modules and seating tools are designed to make multiple pairs of electrical connections at one time. Once a telephone system had been properly installed and all electrical conductors pre-connected, rearrangement of a large-scale network interface unit require a visit from a skilled telephone service technician, who can work through the complex maze of telephone connections and is likely to possess an expensive seating tool for making efficient and effective connections. Rearrangement of a large-scale network interface unit justifies a visit from a telephone service technician or the purchase of a seating tool, which can be time consuming and costly.

When rearrangement of a network interface unit involves only a few electrical connections, it does not justify the cost of purchasing an expensive seating tool or requiring a visit from a telephone service technician. However, with prior art wire connecting blocks, such a task cannot be effectively accomplished without the assistance of a seating tool or a telephone service technician, adding materially to the cost and time expended.

In order to rearrange electrical connections of a telephone system, it is necessary to first trace the telephone connections to the connector module located in the network interface unit, disassemble the electrical connections from the slots of the connector module and then reassemble the electrical connections at slots corresponding to the desired connections on the index strip.

Prior art wire connecting blocks contain a number of shortcomings when handled by an inexperienced person. For example, the two-element prior art wire connecting block does not provide a reliable positive grip of the electrical conductors to allow secure tracing of the wires. The two-element wire connecting block also provides minimum to no electrical isolation of the conductor ends. Furthermore, proper use of the two-element wire connecting block requires an expensive seating tool. On the other hand, while a three-element prior art wire connecting block eliminates some of these drawbacks, it requires the removal of the cap module before the removal of the electrical connections from the connector module. Such a cap module is generally snap mounted onto the connector module by way of a spring-latch-hole interlocking feature, making its removal difficult. Even if removal of the cap module is successful, it can be easily lost or misplaced.

It is therefore the aim of this invention to provide an improved index strip for a wire connecting block that facilitates the rearrangement of electrical connections of the connector module in a simple, positive manner, even by unskilled persons.

SUMMARY OF THE INVENTION

The invention provides an improved device for making electrical connections between conductors. The invention improves upon a two-element prior art wire connecting block to achieve benefits of and beyond a three-element prior art wire connecting block.

The invention provides an integrated push cap that facilitates rearrangement of electrical connections without the assistance of a service technician. The integrated push cap also serves to snub electrical conductors into slotted insulation displacement connectors, thereby eliminating the need of a specialized seating tool.

The invention further provides isolation of the ends of the electrical conductors to minimize short circuits between conductors in an outdoor environment. The invention also provides strain relief on the electrical conductors at the point of contact with the slotted insulation displacement connectors.

The invention provides positive and reliable gripping of electrical conductors to allow secure tracing of wires to the wire connecting block.

The invention, when used for telephone wire connections, contemplates an improved index strip for use in conjunction with existing prior art connector module, such as those described in U.S. Pat. Nos. 3,798,587 and 4,118,095, with a slight modification. The improved index strip of this invention has a plurality of alternating height, spaced-apart, teeth, such as shown in existing prior art index strips. The improved index strip has a pedestal extension supporting a push cap, which is pivotable from an open to closed positions. In the closed position, the push cap is designed to fit over a predetermined sequence of alternating height, spaced-apart, teeth of a prior art connector module mounted on the improved index strip. A protuberance-recess locking mechanism and a separate latching mechanism are provided to keep the push cap in a closed position, yet allows repetitive opening and closing of the push cap. The push cap has a pair of notched ribs on the bottom surface for snubbing and seating a pair of electrical conductors in the slotted insulation displacement connectors of a prior art connector module.

Housed within the pedestal extension of the improved index strip is a pair of openings, such as cylindrical chambers, designed to fit a specific gauge of conductors. The chambers are positioned in alignment with the slots between the teeth of a prior art connector module mounted on the index strip. The ends of electrical conductors are inserted into the mating chambers while the push cap is in an open position, with the body of the electrical conductors resting in the spaces between the alternating height teeth in position for snubbing and seating into the insulation displacement connectors of the prior art connector module. Upon closing the push cap over the teeth of the prior art connector module, the electrical conductors are seated in the slotted insulation displacement connectors, with the ends of the conductors displaced at an angle, forming the letter "L." The chambers effectively isolate the ends of the conductors. The L-shaped conductors serve as strain relieve at the point of contact with the slotted insulation displacement connectors. Furthermore, in combination with the protuberance-recess locking mechanism and the latching mechanism, the angle created along the conductors securely grip the conductors.

DETAILED DESCRIPTION OF THE PREFERRED EMBODIMENTS

Figure 1:
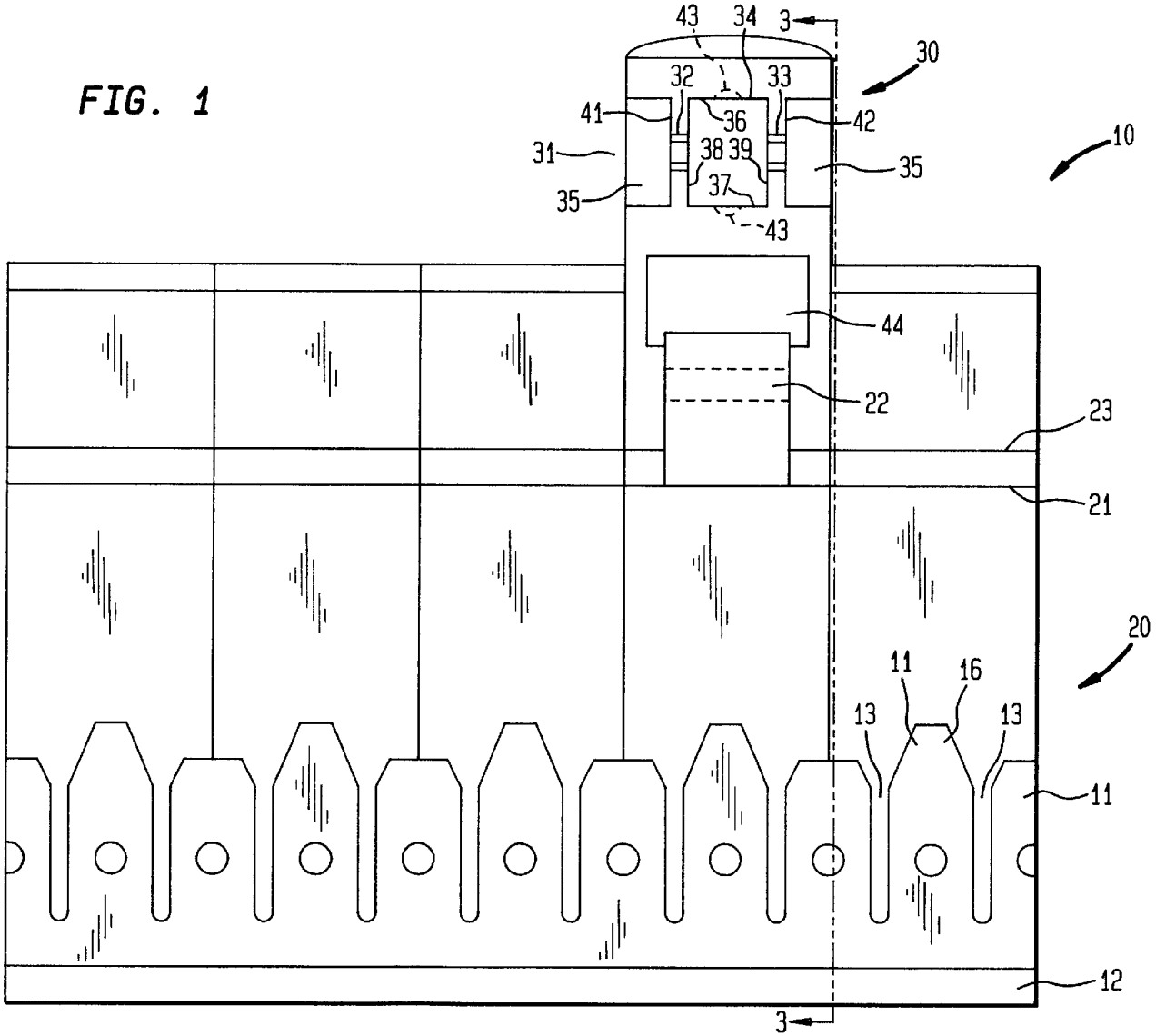
FIG. 1 is a front elevational view of the modified index strip with one integrated push cap attached to the pedestal extension of the present invention in the upright position with the remaining push caps in the closed position.

With reference to the drawings, wherein the same reference number indicates the same element throughout, there is shown in FIG. 1 a modified index strip 10 in accordance with the present invention, showing one integrated push cap 30, in an upright position, attached to pedestal extension 20 of modified index strip 10.

As shown in FIG. 1, the modified index strip 10 includes a plurality of alternating-height, spaced-apart, teeth 11 similar to those of prior art index strip, shown as element 13 in FIG. 1 of U.S. Pat. No. 4,118,095 issued to Berglund et al. on Oct. 3, 1978. The upwardly extending teeth 11 are mounted on base 12. Extending from base 12 is a pedestal extension 20 which pivotally supports the integrated push cap 30, best shown in FIG. 2. The teeth 11, base 12, pedestal extension 20 and push cap 30 are made of a dielectric material.

Figure 3:
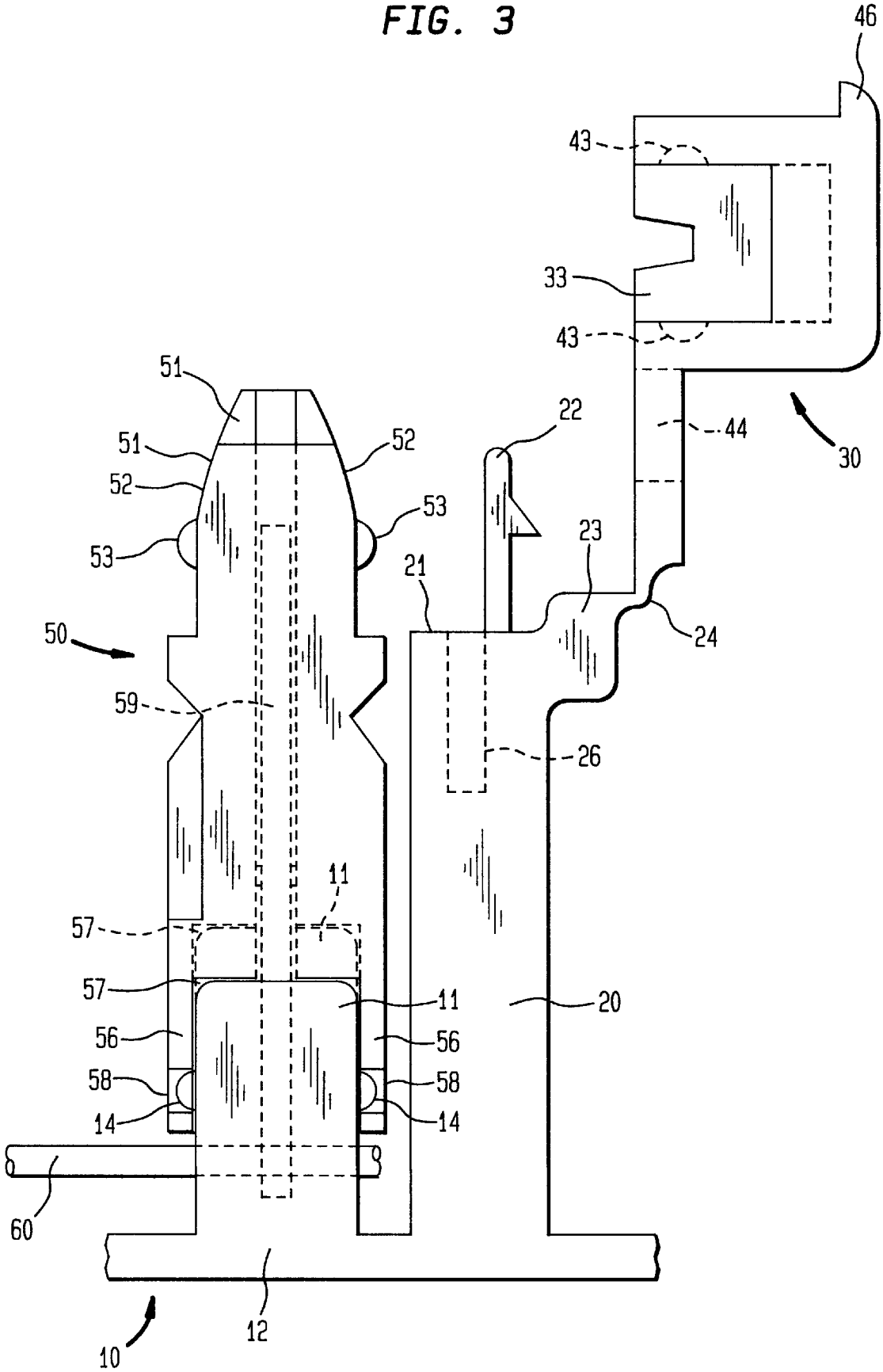
FIG. 3 is a cross sectional view of the modified index strip taken along line 3—3 in FIG. 1, with a prior art connector module mounted thereupon.
Figure 4A:
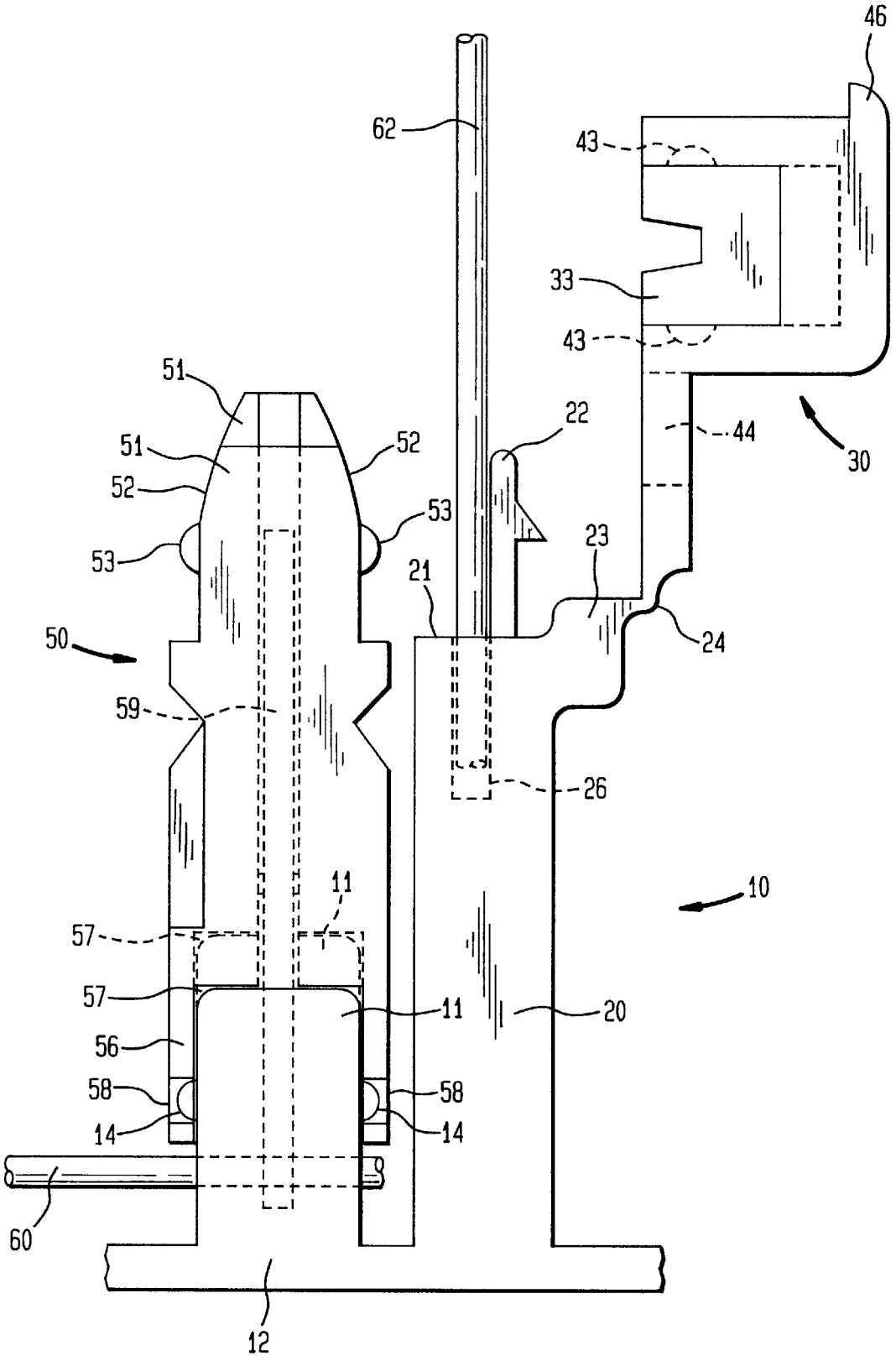
FIG. 4 comprises of FIGS. 4A and 4B are cross sectional views of the modified index strip taken along line 3—3 in FIG. 1, with a prior art connector module mounted thereupon, illustrating the insertion, seating and snubbing of the conductor.
Figure 4B:
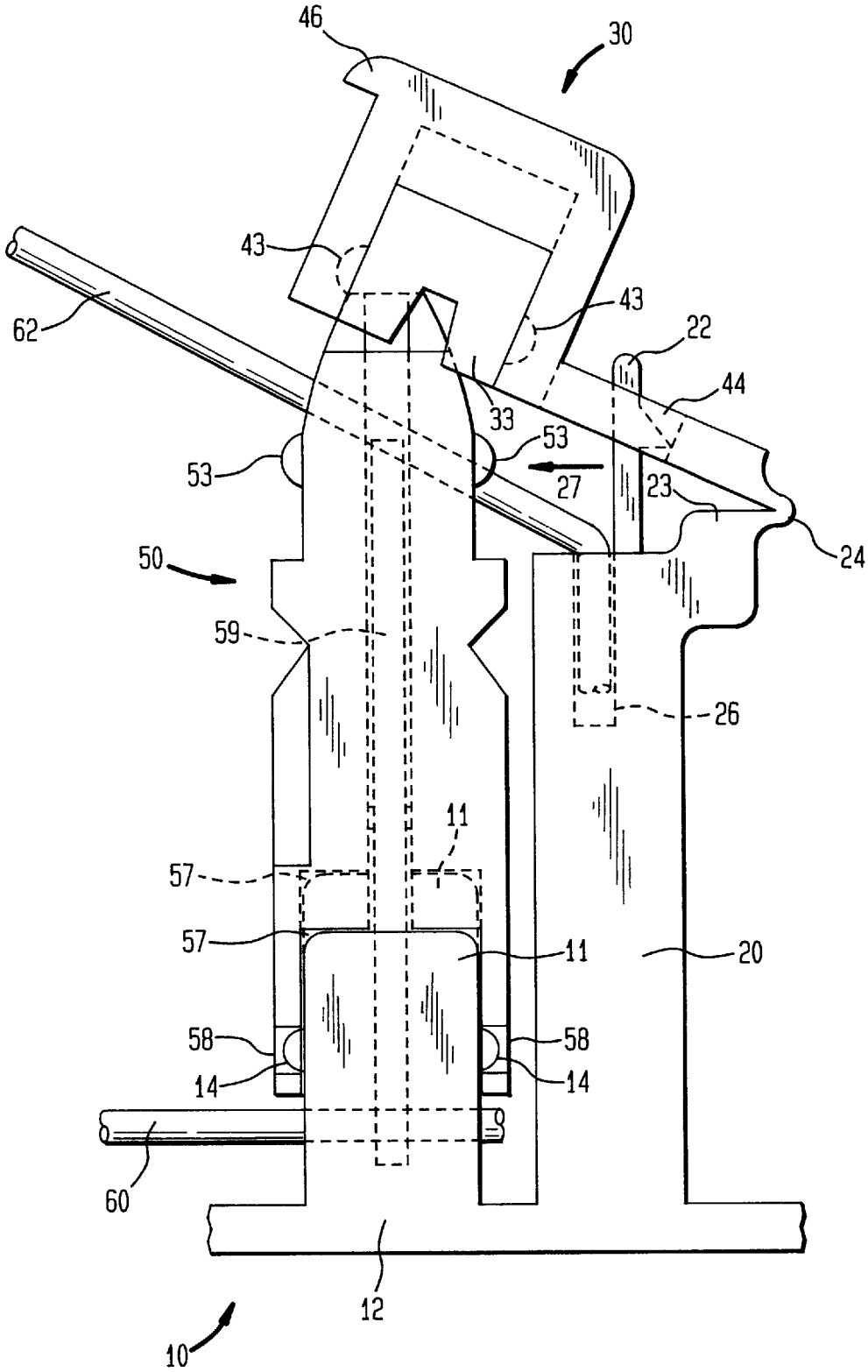

The alternating-height teeth 11 define funnel shaped entry slots 13 therebetween for positioning a first set of conductors 60 for connection with a second set of conductors 62 through a connector module 50, to be described with FIGS. 4A and 4B. Each teeth 11 has a pair of protuberances 14 extending from the two sidewalls 16 which are perpendicular to entry slots 13, best shown in FIG. 2. Teeth 11 and protuberances 14 engage corresponding cavities 57 and apertures 58, respectively, of connector module 50, as shown in FIGS. 3 and 6.

Figure 2:
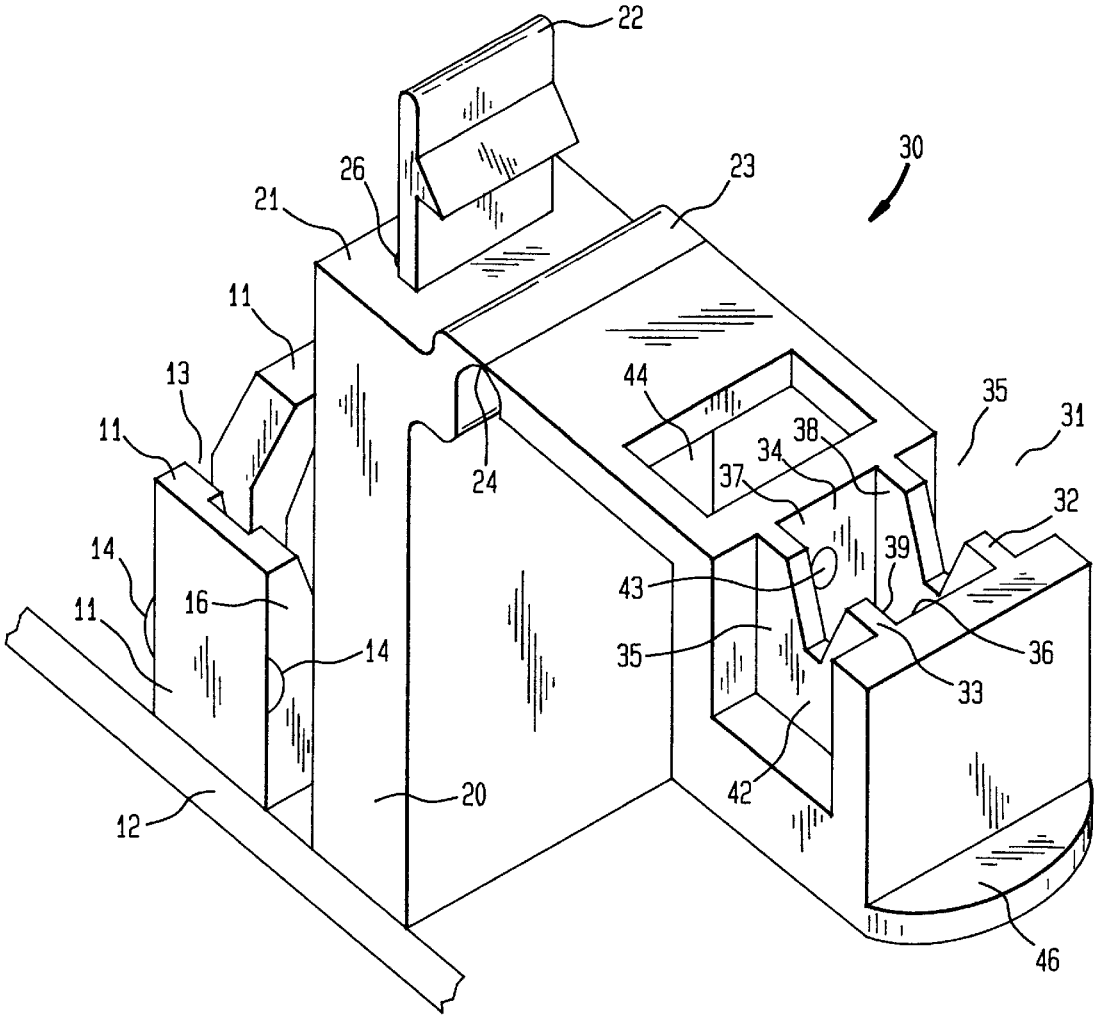
FIG. 2 is a perspective view of the modified index strip showing the pedestal extension having an integrated push cap in an open position.
Figure 5:
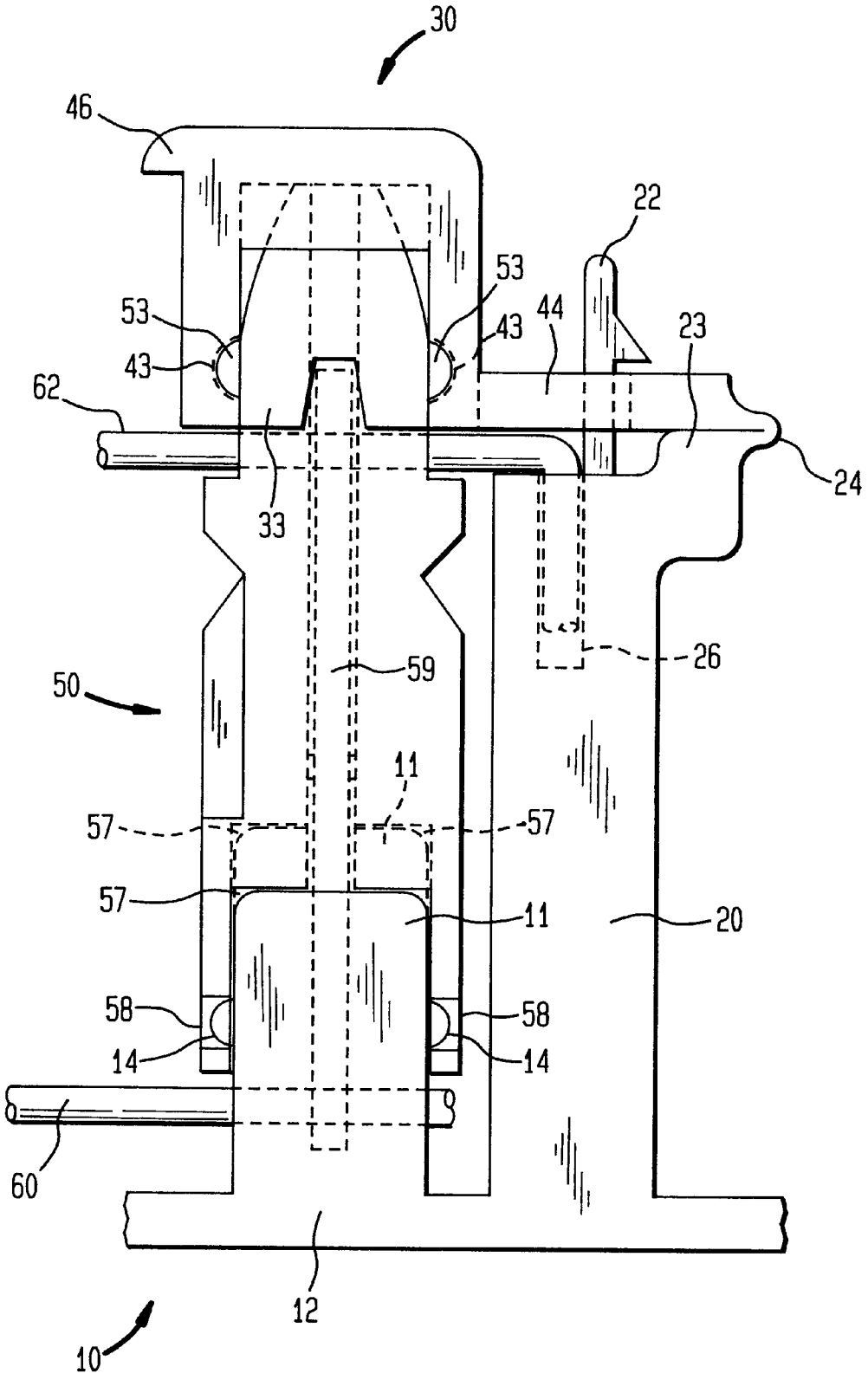
FIG. 5 is a cross sectional view of the modified index strip taken along line 3—3 in FIG. 1, with a prior art connector module mounted thereupon, with the integrated push cap in a closed position.

Best shown in FIG. 2, the pedestal extension 20 has a substantially flat top surface 21, where a latch 22 extends upward from top surface 21. One end of the top surface 21 is a ledge 23, where the integrated push cap 30 is pivotably attached. Ledge 23 provides clearance for a second set of conductors 62 when push cap 30 is in the closed position, as shown in FIG. 5. Pivot point 24 is shown as a living hinge, allowing repetitive opening and closing of the attached push cap 30, but any other pivotable means known to one skilled in the art may be substituted.

Figure 6:
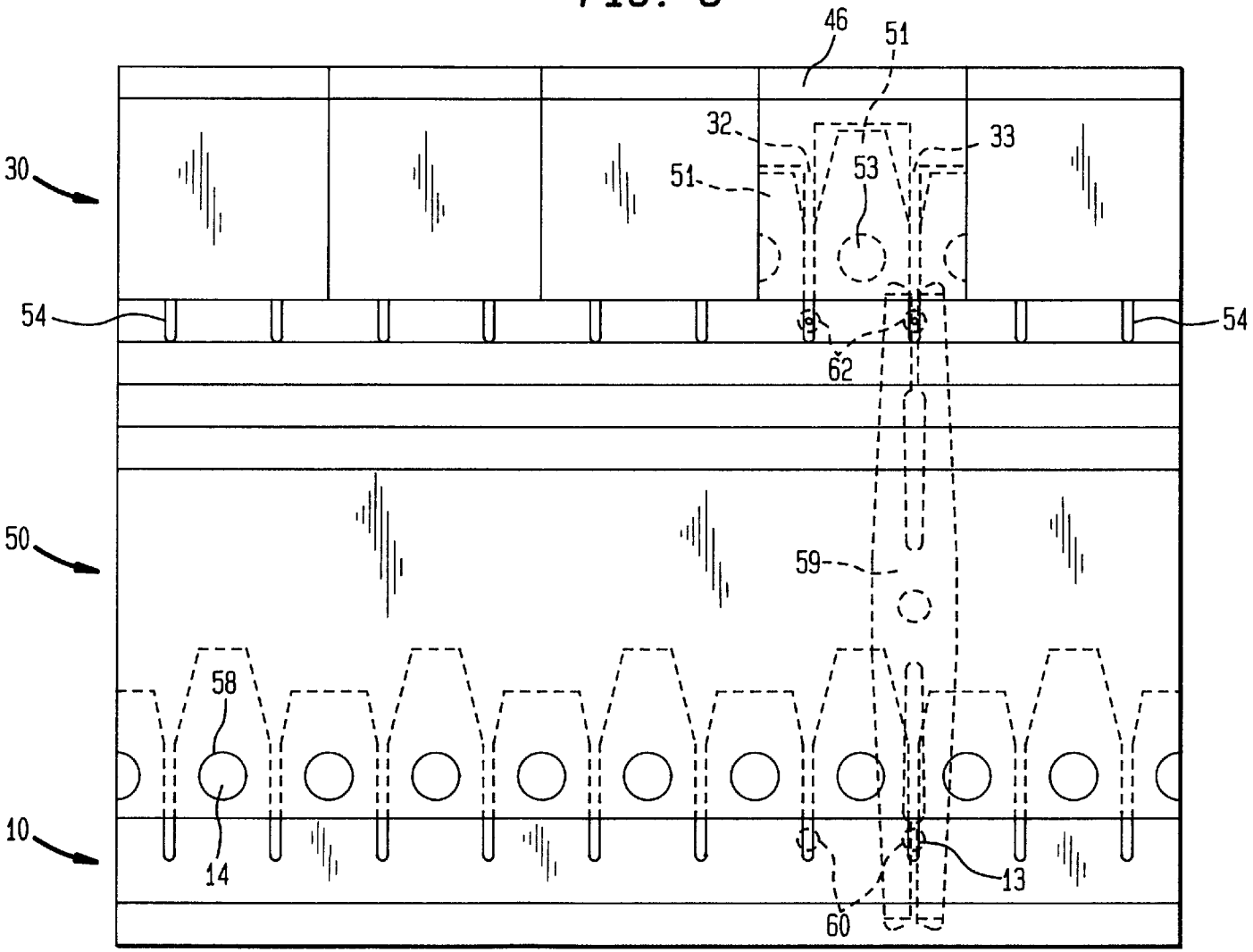
FIG. 6 is a front elevation view of the modified index strip, with a prior art connector module mounted thereupon, with the integrated push caps in a closed position.

On the top surface 21 of pedestal extension 20 is a pair of cylindrical chambers 26 for accommodating the ends of a second set of electrical conductors 62, best shown in FIGS. 3 and 6. Chambers 26 are in alignment with consecutive funnel shaped entry slots 54 of connector module 50 mounted on index strip 10, best shown in FIG. 6. More than one pair of chambers, having various diameters, may be provided on surface 21 of pedestal extension 20 adjacent to chambers 26 for different gauge of wires and similarly in alignment with entry slots 54 of connector module 50 (not shown).

As illustrated in FIGS. 1 and 2, the bottom surface of push cap 30 has a hollow interior 31, segregated into three sections by two substantially parallel notched ribs 32 and 33, a central cavity 34 and a pair of open end sections 35. The notched ribs 32 and 33 are positioned to align with consecutive funnel shaped entry slots 54 of a connector module 50 mounted on index strip 10 and are sized to fit between entry slots 54 and over the insulation displacement connectors 59 (best shown in FIGS. 6 and 7). Cavity 34 is defined by interior front and rear walls 36 and 37, respectively, of push cap 30 and inner facing walls 38 and 39 of the two notched ribs 32 and 33, respectively. The pair of end sections 45 are defined by the interior front and rear walls 36 and 37, respectively, of push cap 30 and the outer facing walls 41 and 42 of the two notched ribs 32 and 33, respectively. Cavity 34 and each of the end sections 35 of push cap 30 is designed to enclose a corresponding teeth 51 of a prior art connector module 50, as shown in and to be described with FIG. 6. On each of the interior front and rear walls 36 and 37 of cavity 34 is a pair of circular recess or opening 43 correspond with a pair of protuberances 53 of teeth 51 of connector module 50, as shown in and to be described with FIGS. 5 and 6, to form a locking mechanism that allows repetitive opening and closing of push cap 30.

The body of push cap 30 also has a rectangular opening 44. When push cap 30 is pivoted to a closed position over the pedestal extension 20, rectangular opening 44 engages latch 22 to form a latching mechanism, best shown in FIG. 5.

FIG. 3 illustrates a connector module 50 mounted on index strip 10. Connector module 50 is similar to element 40 shown in FIGS. 4 and 9 of U.S. Pat. No. 4,118,095 issued to Berglund et al. and element 34 shown in FIG. 1 of U.S. Pat. No. 3,798,587 issued to Ellis, Jr. et al. Connector module 50 is made of a dielectric material.

Connector module 50 has a plurality of alternating-height, spaced-apart, teeth 51, best shown in FIG. 6, similar to teeth 11 of index strip 10. Alternating-height teeth 51 define funnel shaped entry slots 54 therebetween for positioning a second set of conductors 62 for connection with a first set of conductors 60 at entry slots 13 of index strip 10. Each teeth 51 has a pair of protuberances 53 extending from the sidewalls 52 which are perpendicular to entry slots 54. Teeth 51 and protuberances 53 engage corresponding cavity 34 and the pair of open sections 35 and the pair of recesses 43, respectively, of push cap 30, as shown in FIG. 6, to form a locking mechanism that allows repetitive opening and closing of push cap 30.

Mounted within connector module 50 is a plurality of slotted insulation displacement connectors 59 made of electrically conducting material, best shown in FIG. 6. The insulation displacement connectors 59 connect a first set of conductors 60 at entry slots 13 of index strip 10 and a second set of conductors 62 at entry slots 54 of connector module 50.

As shown in FIG. 3, at the opposite end of connector module 50 from teeth 51 is a pair of spaced-apart legs 56 for straddling teeth 11 of index strip 10. The space between legs 56 has cavities 57 which correspond to and mate with teeth 11 of index strip 10. Best shown in FIG. 6, each leg 56 has a plurality of mating apertures 58 for snap engaging corresponding protuberances 14 of index strip 10.

The only modification of connector module 50 from a prior art connector module is the tapering of sidewalls 52 which are perpendicular to entry slots 54. Tapered sidewalls 52 provide clearance for pivoting push cap 30 from an open to a closed position, as shown in FIG. 4B.

FIGS. 4A and 4B illustrate the positioning of a second set of conductors 62 on the modified index strip 10 to achieve wire termination at connector module 50 and contact with a pre-connected first set of conductors 60 at index strip 10. Shown in FIGS. 4A and 4B is a connector module 50 snap mounted on teeth 11 of index strip 10, accomplished by methods known to one skill in the art and disclosed in patents incorporated by reference. The pair of spaced-apart legs 56 of connector module 50 straddle index strip 10, with cavities 57 mating corresponding alternating height teeth 11 of index strip 10. Apertures 58 of legs 56 engage the pair of protuberances 14 of index strip 10 to secure connector module 50 to index strip 10. The first set of conductors 60 is shown to be connected to the insulation displacement connector 59 at entry slots 13 of index strip 10.

As shown in FIG. 4A, the ends of a second set of conductors 62 are inserted into the pair of chambers 26 on surface 21 of pedestal extension 20. FIG. 4B shows that the body of conductors 62 resting in their respectively aligning entry slots 53 of connector module 50. While pivoting push cap 30 to a closed position, tapered sidewalls 52 of connector module 50 provides clearance for cavity 34 and the pair of open end sections 35 of push cap 30. Furthermore, latch 22 is flexed in the direction shown by directional arrow 27 to clear latch hole 44. Upon closing push cap 30, ribs 32 and 33 come into contact with conductors 62 resting in entry slots 53.

Figure 7:
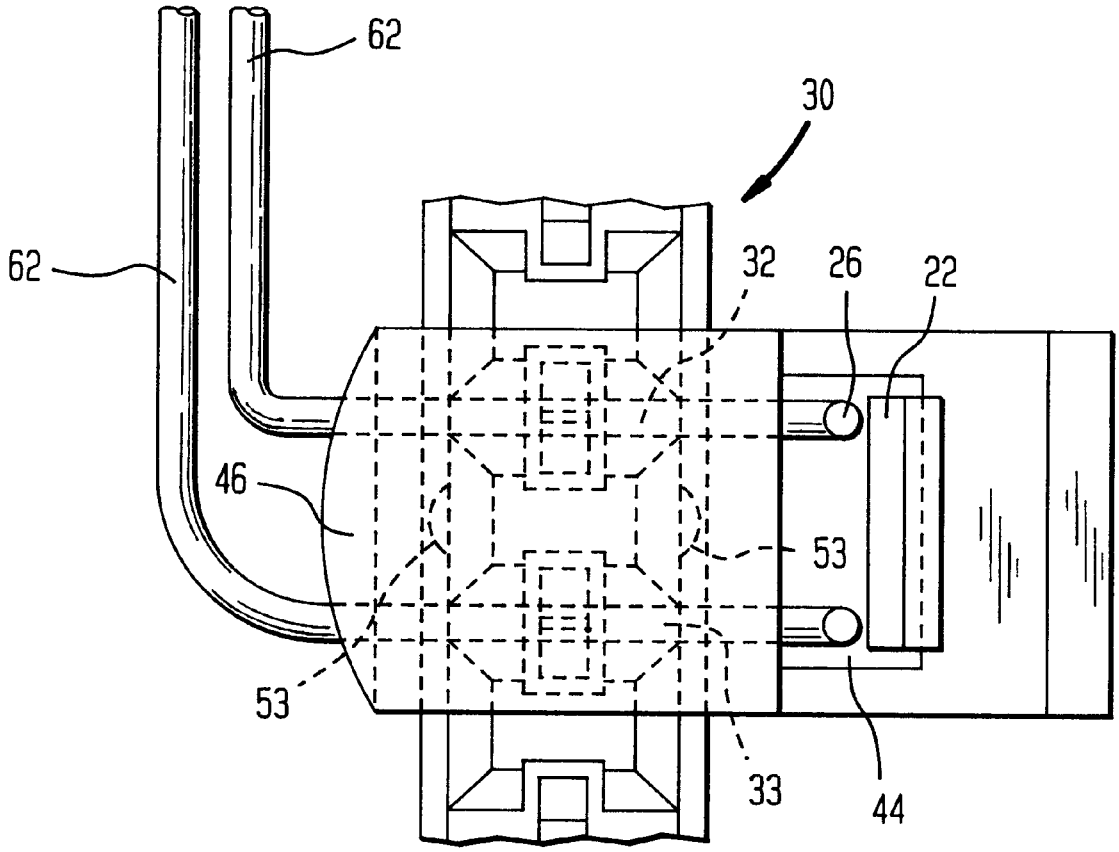
FIG. 7 is a top plan view of the integrated push cap of the modified index strip, in the closed position over a prior art connector module mounted thereupon.

FIGS. 5, 6 and 7 show integrated push cap 30 in a closed position, where electrical contacts are established between a first set of conductors 60 and a corresponding second set of conductors 62 via insulation displacement connector 59.

As shown in FIG. 5, ends of conductors 62 are shown to be fully enclosed and isolated within chambers 26. Electrical conductors 62 are bent at a ninety degree angle with the push cap 30 in the closed position. The L-shaped conductors 62 relieve pressure exerted on conductors 62 at the point of contact with insulation displacement connectors 59 and provide additional gripping of conductors 62. Reliable gripping of conductors 62 is further enhanced by the double locking mechanism of push cap 30. Push cap 30 maintains its closed position with the engagement of the pair of circular recesses 43 of push cap 30 with the pair of protuberances 53 on tapered sidewalls 52 of connector module 50. A second locking mechanism is provided by latch 22 and latch hole 44. Upon full closure of push cap 30, latch 22 returns to its original position, thereby latching push cap 30 in a closed position.

Best shown in FIGS. 6 and 7, complete closure of push cap 30 allows ribs 32 and 33 to engage, seat and snub conductors 62 to achieve contact with insulation displacement connectors 59 of contiguous teeth 51.

Figure 8:
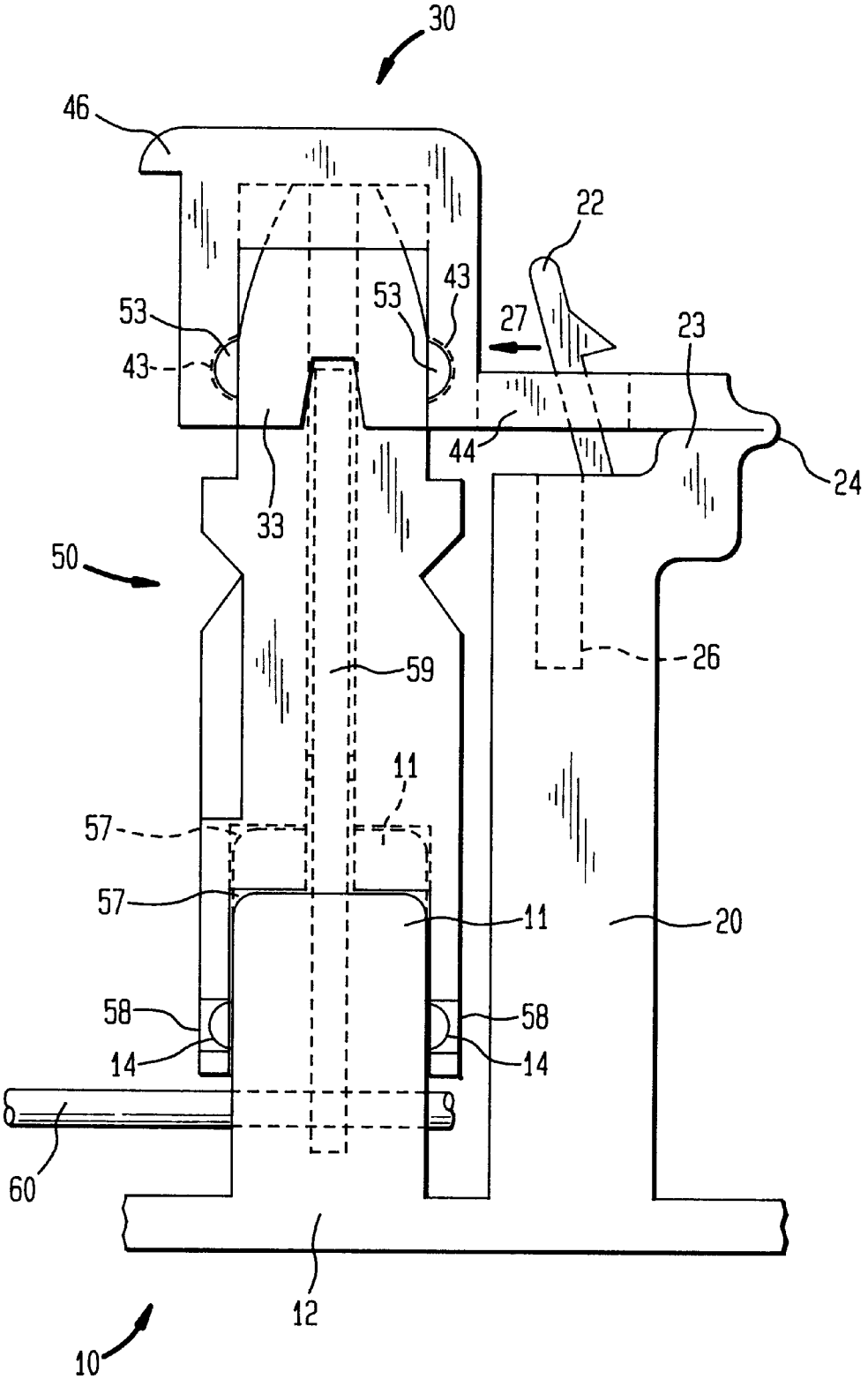
FIG. 8 is a cross sectional view of the modified index strip taken along line 3—3 in FIG. 1, with a prior art connector module attached thereupon, illustrating the opening of the integrated push cap.

The opening of push cap 30 first requires the releasing of latch 22 from latch hole 44. As shown in FIG. 8, force is exerted upon latch 22 to flex it in the direction of directional arrow 27 to clear the latch hole. A ledge 46 on push cap 30 is provided to facilitate the opening of push cap 30 and releasing of the latched circular recesses 43 from protuberances 53. Hence, the opening of push cap 30 is accomplished by a simple pinch and pull of two fingers, one on latch 22 and the other on ledge 46.

Although certain features of the invention have been illustrated and described herein, better modifications and changes will occur to those skilled in the art. It is, therefore, to be understood that the appended claims are intended to cover all such modification and changes that fall within the spirit of the invention.

What I claim is:

1. A device for making electrical connections between a first set of conductors and a second set of conductors via a connector module having at least one insulation displacement connector, said connector module further having a plurality of spaced-apart teeth defining a plurality of entry slots therebetween for positioning said second set of conductors, comprising:

(a) a base;

(b) a plurality of spaced-apart teeth extending from said base, said plurality of teeth defining a plurality of entry slots therebetween for positioning said first set of conductors for engagement with said insulation displacement connectors of said connector module;

(c) a pedestal extension having a top surface extending from said base; and (d) at least one push cap pivotably connected to said pedestal extension to closed and open positions, said push cap having a bottom surface for snubbing one of said second set of conductors in response to said push cap being closed so as to electrically engage said second set of conductors with said insulation displacement connector of said connector module, wherein said top surface of said pedestal extension having one or more pair of cylindrical chambers having different diameters in alignment with said entry slots of said connector module for insertion of said second set of conductors in position for engagement with said insulation displacement connectors by said push cap.

2. The device according to claim 1, wherein said plurality of consecutive spaced-apart teeth have alternating height.

3. The device according to claim 1, wherein said base is made of a dielectric material.

4. The device according to claim 1, wherein said pedestal extension is made of a dielectric material.

5. The device according to claim 1, wherein said push cap is made of a dielectric material.

6. The device according to claim 1 wherein said push cap further having a top surface and a ledge extending beyond said top surface.

7. The device according to claim 1, wherein said bottom surface of said push cap, comprises:

(a) a hollow interior having a front and rear wall; and (b) first and second notched ribs dimensioned to fit between said entry slots of said connector module for pushing said second set of conductors into engagement with said insulation displacement connector, said first and second ribs in alignment with said entry slots of said connector module and perpendicular to said front and rear walls, extending from said front wall to said rear wall.

8. The device according to claim 3, wherein each of said teeth of said connector module further having four tapered sidewalls, said tapered sidewalls perpendicular to said entry slots of said connector module further having a pair of protuberances extending from said sidewalls, said front and rear walls of said hollow interior of said push cap further having a pair of recesses for engaging said protuberances of said connector module to lock said push cap with said connector module.

9. The device according to claim 2, wherein each of said notched ribs having an inner and outer sidewall, a central cavity defined by said front and rear walls of said hollow interior and said inner facing walls of said first and second notched ribs and a pair of end sections defined by said front and rear sidewalls of said hollow interior and said outer facing walls of said first and second notched ribs, said central cavity and said pair of end sections mate with consecutive teeth of said connector module.

10. The device according to claim 3, wherein said pedestal extension having a top surface and a latch extending from said top surface.

11. The device according to claim 10, wherein said push cap further having a latch hole for engaging said latch upon closing said push cap.

12. A device for making electrical connections between a first set of conductors and a second set of conductors via a connector module having at least one insulation displacement connector, said connector module further having a plurality of spaced-apart teeth defining a plurality of entry slots therebetween for positioning said second set of conductors, comprising:

(a) a base;

(b) a plurality of spaced-apart teeth extending from said base, said plurality of teeth defining a plurality of entry slots therebetween for positioning said first set of conductors for engagement with said insulation displacement connectors of said connector module;

(c) a pedestal extension extends from said base having a top surface with a latch extending therefrom and one or more pair of cylindrical chambers having different diameters in alignment with said entry slots of said connector module for insertion of said second set of conductors in position for engagement with said insulation displacement connectors; and (d) at least one push cap pivotably connected to said pedestal extension to closed and open positions, said push cap having a bottom surface comprises a hollow interior having a front and rear wall and first and second notched ribs in alignment with said entry slots and perpendicular to and extending from said front wall and to said rear wall and dimensioned to fit between said entry slots of said connector module for snubbing one of said second set of conductors in response to said push cap being closed so as to electrically engage said second set of conductors with said insulation displacement connector of said connector module, each of said notched ribs having an inner and outer sidewall, a central cavity defined by said front and rear walls of said hollow interior and said inner facing walls of said first and second notched ribs and a pair of end sections defined by said front and rear sidewalls of said hollow interior and said outer facing walls of said first and second notched ribs, said central cavity and said pair of end sections mate with consecutive teeth of said connector module, said push cap further having a latch hole for engaging said latch upon closing said push cap.

* * * * *